US005806308A

United States Patent [19]

Khair et al.

[11] Patent Number: 5,806,308

[45] Date of Patent: Sep. 15, 1998

[54] EXHAUST GAS RECIRCULATION SYSTEM FOR SIMULTANEOUSLY REDUCING $NO_X$ AND PARTICULATE MATTER

[75] Inventors: Magdi K. Khair; William D. Di Silverio, both of San Antonio, Tex.

[73] Assignee: Southwest Research Institute, San Antonio, Tex.

[21] Appl. No.: 888,990

[22] Filed: Jul. 7, 1997

[51] Int. Cl.[6] ..... F02M 25/07

[52] U.S. Cl. ..... 60/278; 60/605.2; 123/568.12

[58] Field of Search ..... 123/568, 569, 123/570, 571; 60/278, 279, 311, 324, 605.2

[56] References Cited

U.S. PATENT DOCUMENTS

| | | | |
|---|---|---|---|
| 4,215,550 | 8/1980 | Dinger et al. | 60/606 |
| 4,462,379 | 7/1984 | Tsuge et al. | 60/278 |
| 4,924,668 | 5/1990 | Panten et al. | 60/278 |
| 5,085,049 | 2/1992 | Rim et al. | 60/279 |
| 5,188,086 | 2/1993 | Adkins et al. | 123/568 |
| 5,203,311 | 4/1993 | Hitomi et al. | 123/570 |
| 5,203,313 | 4/1993 | Rotarius | 123/568 |
| 5,351,669 | 10/1994 | Herzog | 123/568 |
| 5,357,936 | 10/1994 | Hitomi et al. | 123/571 |
| 5,390,492 | 2/1995 | Levendis | 60/278 |
| 5,425,239 | 6/1995 | Gobert | 60/605.2 |
| 5,426,936 | 6/1995 | Levendis et al. | 60/278 |
| 5,657,630 | 8/1997 | Kjemtrup et al. | 60/605.2 |

FOREIGN PATENT DOCUMENTS

| | | | |
|---|---|---|---|
| 2620594 | 11/1976 | Germany | 60/605.2 |
| 3218156 | 11/1983 | Germany | 60/605.2 |
| 3-37318 | 2/1991 | Japan . | |
| 5-71428 | 3/1993 | Japan . | |
| 5-71429 | 3/1993 | Japan . | |
| 9429587 | 12/1994 | WIPO . | |

*Primary Examiner*—Willis R. Wolfe
*Attorney, Agent, or Firm*—Jenkens & Gilchrist

[57] ABSTRACT

An exhaust gas recirculation system for internal combustion engines includes a particulate trap through which all of the gas exhausted through the exhaust manifold of the engine is cleaned prior to directing a first portion of the gas through a low pressure EGR loop and/or discharging all or a remaining portion of the exhaust gas to the surrounding environment. The EGR system embodying the present invention provides an efficient method for reducing $NO_x$ emissions by recirculation of a portion of the exhaust gas and, simultaneously, reducing particulate matter by passing all of the exhaust gas through a passive trap prior to recirculation or discharge to atmosphere.

6 Claims, 1 Drawing Sheet

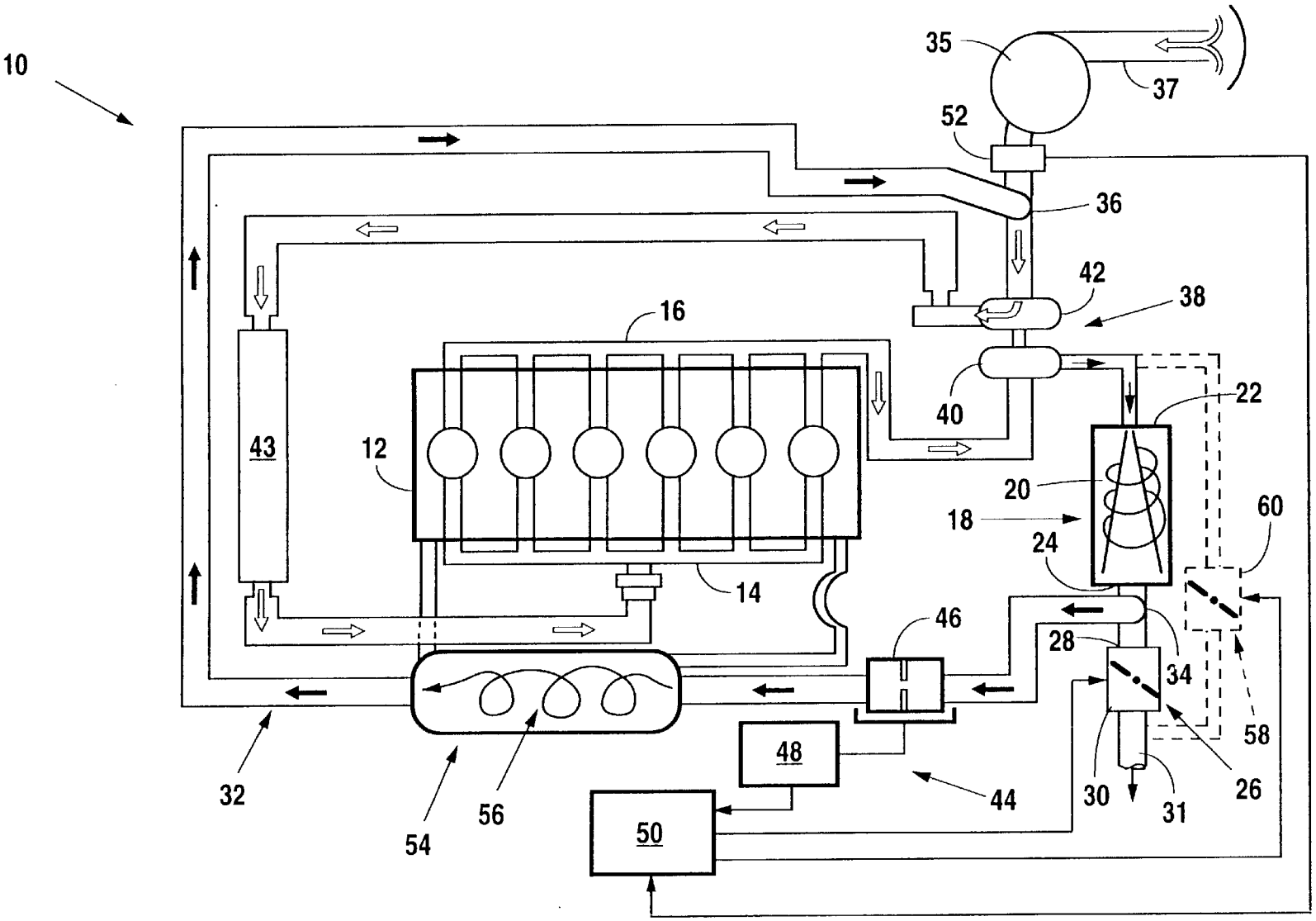
10
12
14
16
18
20
22
24
26
28
30
31
32
34
35
36
37
38
40
42
43
44
46
48
50
52
54
56
58
60

EXHAUST GAS RECIRCULATION SYSTEM FOR SIMULTANEOUSLY REDUCING $NO_X$ AND PARTICULATE MATTER

BACKGROUND OF THE INVENTION

1. Technical Field

This invention relates generally to an exhaust gas recirculation system, and to a method for recirculating exhaust gas, and more particularly to such a system and method in which all of the exhaust gas and all of the recirculated gas is directed through a particulate trap.

2. Background Art

Exhaust gas recirculation (EGR) is a well-known method for reducing the concentration of various undesirable oxides of nitrogen ($NO_x$). For example, PCT International Publication No. W094/29587 for A LARGE SUPERCHARGED DIESEL ENGINE describes an EGR system in which a part of the recycled exhaust gas is humidified prior to reintroduction into the engine combustion chamber, for the purpose of reducing $NO_x$. However, the disclosed system provides no means for reducing particulate matter, i.e., mostly carbon, in the exhaust stream.

An exhaust gas recirculation system in which only a portion of the exhaust gas, more specifically the recirculated portion, is passed through a soot trap, is disclosed in Japanese unexamined applications Nos. 5-71428 and 5-71429, both entitled EXHAUST GAS REFLUX DEVICE OF DIESEL ENGINE. While the EGR and particulate trap arrangement disclosed in the Japanese publications may be effective in reducing particulate matter in the recirculated exhaust gas stream, it does not reduce particulate matter in the exhaust stream when either flow through the EGR system is reduced, or the EGR system is bypassed entirely, e.g., during hard acceleration. The described systems employ a back pressure device in the exhaust stream prior to passing the stream through a particulate trap. Thus, the systems described in the Japanese publications do not pass all of the exhaust gas through the soot trap, and therefore cannot simultaneously control $NO_x$ and particulate matter (PM) emissions.

The present invention is directed to overcoming the problems set forth above. It is desirable to have a controlled exhaust gas recirculation system which is not only effective in reducing $NO_x$, but also removes particulate matter from the recirculated gas as well as gas exhausted to the surrounding atmosphere. It is also desirable to have such an exhaust gas recirculation system that requires only a single back pressure valve to regulate the relative amounts of exhaust gas recirculated through the exhaust gas system and discharged into the surrounding environment.

SUMMARY OF THE INVENTION

In one aspect of the present invention, an exhaust gas recirculation system for an internal combustion engine which has an intake manifold and an exhaust manifold includes an exhaust system having a particulate trap which has a first end in fluid communication with the exhaust manifold of the engine, and a second end spaced from the first end. A back pressure valve has a first end that is in fluid communication with the second end of the particulate trap. The exhaust gas recirculation system further includes an exhaust gas recirculation passageway having an inlet end interposed between the second end of the particulate trap and the full extent of the back pressure valve. The exhaust gas recirculation passageway also has an outlet end that is in fluid communication with the intake manifold of the engine.

Other features of the exhaust gas recirculation system embodying the present invention include a turbocharger having a drive turbine section interposed between the exhaust manifold of the engine and the first end of the particulate trap, and a compressor stage interposed between the outlet end of the exhaust gas recirculation passageway and the intake manifold of the engine.

Yet other features include a means for measuring gas flow through the exhaust gas recirculation passageway and a means for cooling exhaust gas during recirculation through the exhaust gas recirculation passageway. In another aspect of the present invention, an exhaust gas recirculation system for a turbocharged engine comprises an exhaust system that has a particulate trap having a first end in fluid communication with the outlet of a turbine stage of a turbocharger and a second end spaced from the first end. The system also includes a back pressure valve having a first end in fluid communication with the second end of the particulate trap and a second end in fluid communication with the environment surrounding the engine. The system also includes an exhaust gas recirculation passageway that has an inlet end interposed between the second end of the particulate trap and the first end of the back pressure valve, and an outlet end in fluid communication with an inlet of a compressor stage of the turbocharger. Further, the exhaust gas recirculation system for a turbocharged engine includes a means for measuring gas flow through the exhaust gas recirculation passageway, and a means for cooling exhaust gas during recirculation through the exhaust gas recirculation passageway.

In yet another aspect of the present invention, a method for recirculating exhaust gas includes discharging exhaust gas from at least one exhaust port of an engine into an exhaust manifold, passing the discharged exhaust gas through a particulate trap in fluid communication with the exhaust manifold whereby the discharged exhaust gas is cleaned by removing particulate matter, and controllably passing a first portion of the cleaned exhaust gas through an exhaust gas recirculation passageway after passing the discharged exhaust gas through the particulate trap. The first portion of the cleaned exhaust gas is directed to an intake manifold of the engine. The method further includes controllably discharging a second portion of the cleaned exhaust gas into an environment exterior of the engine.

Other features of the method for recirculating exhaust gas, embodying the present invention, include determining the volumetric flow rate of the cleaned exhaust gas passing through the exhaust gas recirculation passageway. Other features of the method include passing the exhaust gas discharged from the exhaust manifold of the engine through a turbine section of a turbocharger that is in fluid communication with exhaust manifold and with the particulate trap, prior to passing the discharged exhaust gas through the particulate trap.

Other features of the method for recirculating exhaust gas include compressing the first portion of the cleaned exhaust gas prior to discharging the first portion of the cleaned exhaust gas into the intake manifold of the engine. Still other features of the method include determining the volumetric flow rate of the first portion of the cleaned exhaust gas passing through the exhaust gas recirculation passageway, and passing the first portion of the cleaned exhaust gas through a heat exchanger disposed in fluid communication with the exhaust gas recirculation passageway.

BRIEF DESCRIPTION OF THE DRAWINGS

A more complete understanding of the structure and operation of the present invention may be had by reference to the following detailed description when taken in conjunction with the accompanying drawing, which is a schematic representation of an internal combustion engine having an exhaust gas recirculation system embodying the present invention.

DETAILED DESCRIPTION OF PRESENTLY PREFERRED EXEMPLARY EMBODIMENTS

In the preferred embodiment of the present invention, an exhaust gas recirculation system 10 for an internal combustion engine 12 is shown schematically in the sole drawing figure. The engine 12 has an intake manifold 14 in direct communication with the intake ports of the engine cylinders, and an exhaust manifold 16 in direct fluid communication with the exhaust ports of each of the cylinders of the engine 12. An exhaust system 18 includes a particulate trap 20 that has a first end 22 in fluid communication with the exhaust manifold 16 of the engine 12. Preferably, the particulate trap 20 is a passive, continuously regenerative trap, such as a Corning Wallflow EX80 and uses an additive containing cerium oxide to lower the combustion temperature of carbon, making it easier to ignite carbon deposited in the trap. The particulate trap 20 also has a second end 24 that is spaced from the first end 22.

The exhaust system 18 also includes a back pressure valve 26 that has a first end 28 in fluid communication with the second end 24 of the particulate trap 20, and a second end 30 that is in fluid communication with the external environment surrounding the engine 12 via a tailpipe 31. The exhaust gas recirculation system 10 further includes an exhaust gas recirculation passageway 32 that has an inlet end 34 interposed between the second end 24 of the particulate trap 20 and the first end 28 of the back pressure valve 26. The exhaust gas recirculation passageway 32 also has an outlet end 36 that is in fluid communication with the intake manifold 14 of the engine 12. More specifically, the outlet end 36 of the EGR passageway 32 is positioned between an air filter 35, disposed in an inlet duct 37, and the inlet to a compressor stage 42 of a turbocharger 38.

In the illustrated embodiment of the present invention, the EGR system 10 includes the turbocharger 38 which has a drive turbine section 40 interposed between the exhaust manifold 16 and the first end 22 of the particulate trap 20. The turbocharger compressor stage 42 is interposed between the outlet end 36 of the EGR passageway 32 and the intake manifold 14 of the engine 12. Furthermore, in the illustrated preferred embodiment, compressed intake air or mixture of recirculated exhaust gas and air, is desirably directed through an intercooler 43 after discharge from the compressor stage 42 of the turbocharger 38 and prior to introduction into the intake manifold 14 of the engine 12.

Desirably, the EGR system 10 also includes a means 44 for measuring gas flow through the exhaust gas recirculation passageway 32. In the illustrated embodiment, the means 44 for measuring flow through the EGR passageway 32 includes a control orifice 46 disposed in the EGR passageway 32 downstream of its inlet end 34. The pressure drop across the control orifice is measured, and the measured values delivered to a pressure differential (ΔP) switch 48. The ΔP switch 48 provides an electronic signal correlative of the sensed pressure differential across the control orifice 46, and delivers that signal to an electronic engine control unit (ECU) 50. Alternatively, the means for measuring mass flow through the EGR passageway 32 may comprise an inlet air mass flow transducer 52, such as a hot-wire anemometer, either by itself or in combination with the control orifice 46. The inlet air mass flow transducer 52 provides an electrical signal corresponding to the intake air mass flow and delivers that signal to the electronic engine control unit 50. The engine inlet air flow, without EGR, has a known value for a given steady-state engine operating point, defined by engine speed and manifold pressure. Therefore, when the backpressure valve 26 is modulated to induce EGR flow, some of the fresh inlet air flow at the operating point will be displaced by the EGR flow. The actual fresh air inlet flow measured by the inlet air mass flow transducer 52 can be compared with the expected inlet air flow without EGR. The difference between these two values represents the EGR flow.

Thus, the EGR flow control orifice 46 and/or the inlet air mass flow transducer, in conjunction with the back pressure valve 26, is used to induce EGR flow through the EGR passageway 32 and provide a feedback signal to the electronic control unit 50 via the pressure switch (ΔP transducer) 48. Based on the value of the feedback signal from the pressure switch 48, the engine electronic control unit 50 modulates the closing and opening of the back pressure valve 26 to induce the desired pressure differential (and EGR flow) across the flow control orifice 46 and consequently into the engine intake manifold 14.

The EGR system 10, embodying the present invention, desirably further includes a means 54 for cooling exhaust gas during circulation of exhaust gas through the exhaust gas recirculation passageway 32. In the exemplary embodiment illustrated in the drawing figure, the means 54 for cooling the exhaust gas comprises a jacket water exhaust gas recirculation cooler 56, disposed downstream of the EGR control orifice 46, to reduce the temperature of exhaust gas circulating through the EGR passageway 32. In certain engine applications, the means for cooling exhaust air during circulation of exhaust gas through the gas recirculation passageway may comprise either one, or both, of the intercooler 43 disposed between the compressor stage 42 of the turbocharger 38, and the intake manifold 14, and/or the cooler 56 disposed in the passageway 32 itself.

The EGR system 10 may, optionally, include a bypass circuit 58 that enables the diversion of exhaust gas from the turbocharger turbine 40 directly to the environment exterior of the engine. The bypass circuit 58 may be desirable for short term operation in the event that the particulate trap 20 should become clogged, require lower flow rate for self-cleaning, or should the back pressure valve 26 become inoperative. The bypass circuit 50 desirably includes a bypass valve 60 that, when fully closed, blocks the bypass circuit 58 and thereby directs all of the exhaust flow from the turbine section 40 of the turbocharger 38 through the particulate trap 20 and thence either into the EGR passageway 32 or through the back pressure valve 26. When in a fully open position, the bypass valve 60 permits all of the exhaust flow to bypass the particulate trap 20 and the back pressure valve 26 and flow directly into the external environment via the exhaust pipe downstream of the back pressure valve 26. When at a position between fully open and fully closed, the bypass valve 60 controls the relative amounts of exhaust gas passing through the bypass circuit 58 and through the particulate trap 20. As a result of reducing exhaust gas flow through the particulate trap 20, the velocity of the gas flow through the trap 20 is reduced, thereby increasing the residence time of the gas in the trap and improving heat transfer which enhances the combustion of carbon deposited within the trap 20. Desirably, the operation of the bypass valve 60 is controlled by the electronic control unit 50.

By following the directional arrows in the schematic diagram, a method for recirculating exhaust gas in an internal combustion engine having the above-described arrangement of components, can be readily understood. Exhaust gas discharged from one or more ports of the engine 12 into the exhaust manifold 16 is passed through the particulate trap 20 that is in fluid communication with the exhaust manifold 16. All of the exhaust gas discharged from exhaust manifold 16 is cleaned by removing particulate matter from the discharged exhaust gas as it passes through the particulate trap 20. Downstream of the particulate trap 20 the first portion of the exhaust gas, cleaned by the particulate trap 20, is controllably directed, depending upon the position of the back pressure valve 26, through the exhaust gas recirculation passageway 32. The first portion of the cleaned exhaust gas passing through the EGR passageway 32 is subsequently redirected back to the intake manifold 14 of the engine 12. The portion of the cleaned exhaust gas not directed through the EGR passageway 32 is discharged, through the back pressure valve 26, directly into the surrounding atmosphere, via the tailpipe 31 extending from the back pressure valve 26.

Desirably, the mass flow rate of the first portion of exhaust gas directed through the EGR passageway 32 is measured by sensing the pressure drop across the control orifice 46, and a signal, representative of that pressure differential, is delivered to the ECU 50 which, in turn, controls the operation of the back pressure valve 26. When the back pressure valve 26 is fully open, most of the exhaust flow is discharged to the external environment; when partially closed, the exhaust discharged to the external environment is reduced and the first portion of the clean gas is directed through the EGR passageway 32. Also desirably, the method for recirculating exhaust gas includes directing the gas discharged from the exhaust manifold 16 through the turbine section 40 of the compressor 38, prior to passing the discharged exhaust gas through the particulate trap 20. When used in conjunction with a turbocharged engine, the method for recirculating exhaust gas also includes compressing the first portion of the cleaned exhaust gas that is passed through the EGR passageway 32 prior to discharging the portion of the cleaned exhaust gas into the intake manifold 14 of the engine 12.

Desirably, the method for recirculating exhaust gas, embodying the present invention, further includes passing the first portion of the cleaned exhaust gas through a heat exchanger 56 that is disposed in fluid communication with the exhaust gas circulation passageway 32.

In summary, the preferred embodiment of the EGR system 10, embodying the present invention, comprises a low pressure loop 32 with exhaust gas supplied from a point downstream of the particulate trap 20. The back pressure valve 26 is partially closed in response to signals from the electronic control unit 50 to supply the necessary pressure differential between the inlet end 34 and the outlet end 36 of the EGR passageway 32 to assure recirculation of the desired quantity of exhaust gas under specific engine operating conditions. Thus, the exhaust gas recirculation system 10 embodying the present invention reduces $NO_x$ by recirculating controlled amounts of exhaust gas back into the intake of an engine, and simultaneously removes particulate matter from all of the exhaust gas, both the recirculated portion and the portion exhausted to the atmosphere.

Although the present invention is described in terms of a preferred exemplary embodiment, those skilled in the art will recognize that changes in the way the relative rates of the recirculated exhaust gas are controlled, and in the manner in which the EGR flow rate is sensed or regulated, may be made, consistent with the specifically stated positional requirements, without departing from the spirit of the invention. Such changes are intended to fall within the scope of the following claims. Other aspects, features and advantages of the present invention can be obtained from a study of this disclosure and drawings, along with the appended claims.

What is claimed is:

1. An exhaust gas recirculation system for an internal combustion engine having an intake manifold and an exhaust manifold, said exhaust gas recirculation system comprising:

an exhaust system comprising a particulate trap having a first end in fluid communication with said exhaust manifold of the engine, a second end spaced from said first end, and a back pressure valve having a first end in fluid communication with the second end of said particulate trap;

an exhaust gas recirculation passageway having an inlet end interposed between the second end of said particulate trap and the first end of said back pressure valve, and an outlet end in fluid communication with the intake manifold of said engine.

2. An exhaust gas recirculation system, as set forth in claim 1, wherein said exhaust gas recirculation system includes a turbocharger having a drive turbine section interposed between said exhaust manifold of the engine and the first end of said particulate trap.

3. An exhaust gas recirculation system, as set forth in claim 2, wherein said turbocharger has a compressor stage interposed between the outlet end of the exhaust gas recirculation passageway and the intake manifold of the engine.

4. An exhaust gas recirculation system, as set forth in claim 1, wherein said exhaust gas recirculation system includes a means for measuring gas flow through said exhaust gas recirculation passageway.

5. An exhaust gas recirculation system, as set forth in claim 1, wherein said exhaust gas recirculation system includes a means for cooling exhaust gas during circulation of exhaust gas through the exhaust gas recirculation passageway.

6. An exhaust gas recirculation system for a turbocharged internal combustion engine having an intake manifold and an exhaust manifold, and a turbocharger having a turbine stage which has an inlet in fluid communication with said exhaust manifold and an outlet spaced from the inlet and a compressor stage having a first end in fluid communication with air in the environment surrounding said engine and a second end in fluid communication with said intake manifold of the engine, said exhaust gas recirculation system comprising:

an exhaust system that includes a particulate trap having a first end in fluid communication with said outlet of the turbine stage of said turbocharger and a second end spaced from said first end of the particulate trap;

a back pressure valve having a first end in fluid communication with the second end of said particulate trap and a second end in fluid communication with the environment surrounding said engine;

an exhaust gas recirculation passageway having an inlet end interposed between the second end of said particulate trap and the first end of said back pressure valve, and an outlet end in fluid communication with the first end of the compressor stage of said turbocharger;

a means for measuring gas flow through said exhaust gas recirculation passageway; and a means for cooling exhaust gas during circulation of the gas through the exhaust gas recirculation passageway.

* * * * *